United States Patent [19]

Delligatti

[11] 3,977,317

[45] Aug. 31, 1976

[54] PRINTING WHEEL

[76] Inventor: Patrick Delligatti, c/o Dalemark Industries, 950 Airport Road, Lakewood Industrial Park, Lakewood, N.J. 08701

[22] Filed: June 20, 1975

[21] Appl. No.: 588,765

[52] U.S. Cl. ..... 101/35; 101/375

[51] Int. Cl.[2] ..... B41F 17/00; B41F 13/10

[58] Field of Search ..... 101/4, 35–37, 101/76, 84, 93.22, 375–377; 197/18, 53–55

[56] References Cited

UNITED STATES PATENTS

| | | | |
|---|---|---|---|
| 3,306,416 | 2/1967 | Dahlin et al. | 197/6.6 |
| 3,314,214 | 4/1967 | Burt | 101/36 X |
| 3,596,593 | 8/1971 | Wada | 101/93.28 X |
| 3,702,000 | 10/1972 | Delligatti | 101/35 X |
| 3,808,970 | 5/1974 | Delligatti | 101/35 |

*Primary Examiner*—Edgar S. Burr
*Assistant Examiner*—Paul T. Sewell

[57] ABSTRACT

A printing wheel for use in code marking machines is comprised of a hollow cylindrical type carrier rotatably mounted on a stationary spindle assembly, the type carrier and spindle assembly each containing magnetic members which align to keep the type carrier in a fixed position until rotated by an external force. A magnetic damper means may be provided to prevent oscillation or "hunting" of the type carrier when it returns to the null or fixed position by magnetic attraction between the fixed and rotating magnets.

4 Claims, 3 Drawing Figures

PRINTING WHEEL

THE PRIOR ART

Figure 1:
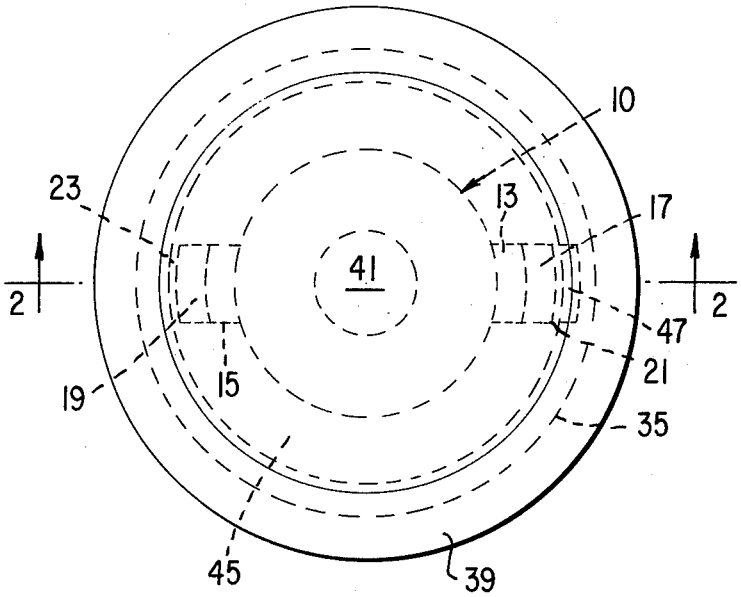

In recent years the marking of products by some identification number or date has become an established step in a great many industries to enable control of quality, to provide production and accounting records and other relevant data dealing with the manufacture and use of the particular product. As a result of this development there have been designed a wide variety of printing devices which can readily be incorporated into production lines and which will emplace the desired data on the products produced on the particular lines. For the most part these devices are in the form of printing devices which utilize an ink impregnated or ink coated type which contacts each individual product or packages or containers containing the product to imprint the desired indicia thereon, be this data related to dates, code numbers, lot numbers or whatever.

One of the most frequently used devices employed to print data on products is a printing wheel having a cylindrical type carrying face on which changeable type fonts are mounted and having a friction surface which engages a moving product whereby the wheel is rotated in bringing the type face into contact with an ink supply and then into rolling contact with the particular product to print thereon the information defined by the type fonts. In order to assure that each product is imprinted and that the printed information is located at the same pre-determined area on the product or the containers, as may be the case, the print wheel is biased to a null position after each product passes by and is imprinted. This rotation back to the null position, regardless of the number of degrees the wheel rotates in the printing operation, is generally affected by means of some form of spring biased cam and cam follower combination wherein the low point on the cam defines the null position of the printing wheel. As the wheel is rotated the cam follower or the cam, as the case may be, is biased toward the high point on the cam against the action of a fairly strong spring, to provide a return bias of spring energy tending to bias the wheel toward its null position as the cam follower tends to return to the low point on the cam. One illustration of such a printing wheel is found in U.S. Pat. No. 3,808,970, issued to the same inventor as herein named and in various prior art cited during the prosecution of the application which matured into said patent.

With but few exceptions all of these prior art print wheels are adequate to perform the desired function over reasonable periods of time. But like all man made devices they are subject to improvement in both performance and durability. Some of the contributing factors to the prior art deficiencies are weaking biasing springs, cam and follower wear which results in variations in null position and thus variations in the location of the imprinted matter. Additionally the failure to keep the wheels properly lubricated so that the spring bias is effective often results in unsatisfactory print wheel performance.

The present invention deals with a printing wheel sometimes referred to as a code-dating wheel which will perform the desired function and yet is totally free of the potentially troublesome mechanical null position cams, followers springs, etc. Thus the principal object of the invention, among many that will be readily apparent to those skilled in the art but are not specifically mentioned here, is to provide a durable, fast acting print wheel which is completely free of any mechanical null devices.

THE INVENTION

Figure 3:
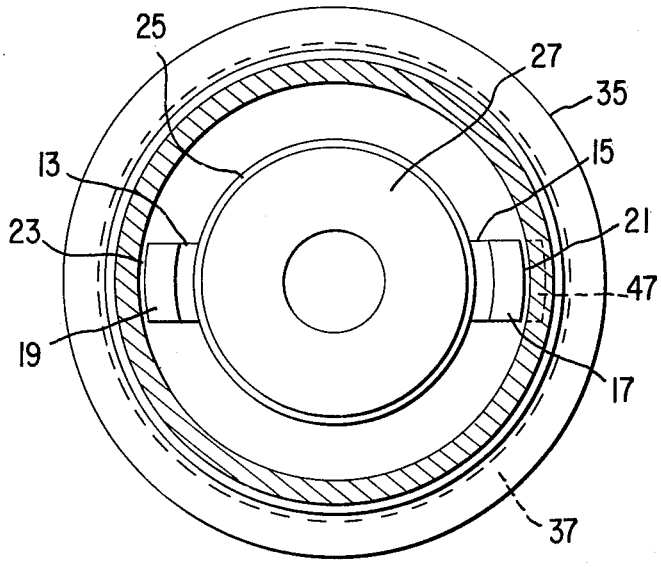
Figure 2:
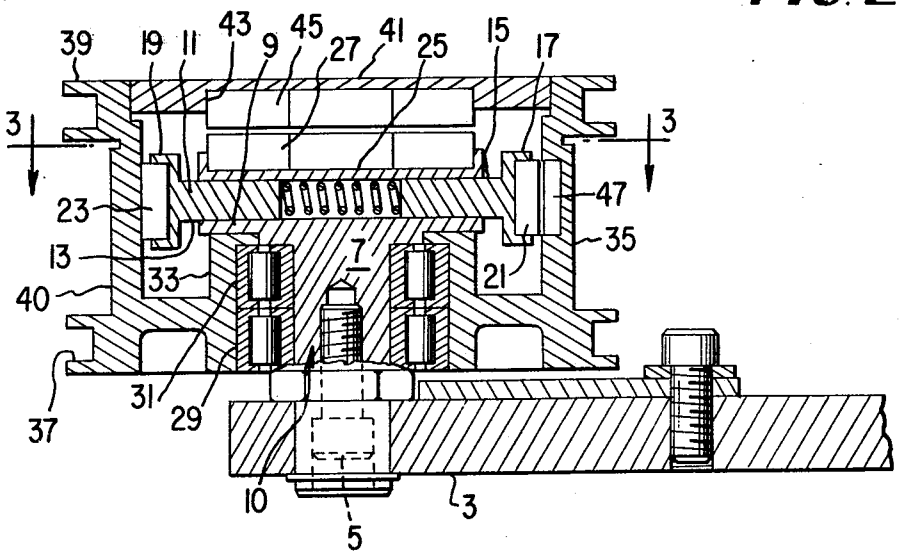

Having broadly outlined the objects of the invention attention is directed to the following detailed description taken in conjunction with the drawings wherein:

FIG. 1 is a top plan view of a printing wheel embodying the instant invention, FIG. 2 is a sectional view taken along the line 2—2 of FIG. 1, and FIG. 3 is a plan sectional view taken along the line 3—3 of FIG. 2.

As clearly shown in FIGS. 1 and 2, the printing wheel includes a stationary spindle assembly 10 which is mounted on a conventional support bracket 3 by a cap screw 5 which is threadedly engaged with the center of spindle assembly 10. The spindle assembly is comprised of a central cylindrical hub 7 having a flat disc shaped top surface 9. Seated on the top of the surface 9 is an annular carrier element 11 having a pair of diametrically extending arms 13 and 15 the ends of which define sockets 17 and 19. Fitted within socket 17 is a magnetic pole piece 21, while socket 19 is fitted with a weight element 23 preferably of lead or some similar heavy metallic material which acts as a counterbalance against the weight of the magnetic pole piece 21. Seated on top of the annular carrier element is a cup shaped magnet holder 25 which receives an annular magnet 27. The carrier element 11, holder 25 and annular magnet 27 are fastened to the spindle by any suitable fastening means, not shown, so that they all are held stationary.

Surrounding hub 9 are a pair of roller bearing means 29 and 31 of conventional design. The outer races of the bearing means are seated within a cylindrical boss 33 which is an integral inverted cup shaped part of a cylindrical type carrier 35 having a pair of upper and lower grooved flanges 37 and 39 opening outwardly away from the outer type carrying surface 40. These grooved flanges receive bands of some type of resilient friction material as is conventional in the art, while surface 40 receives changeable type fonts as is also conventional in the art.

The upper end of the cylindrical type carrier 35 is closed by a disc shaped cover 41 having a central recess 43 into which is fitted an annular magnetic member 45 of identical configuration to the annular magnet 27 mounted on the spindle assembly 10. Embedded within the cylindrical wall of the type carrier 35 is a further magnetic pole piece 47.

OPERATION

The manner in which the printing wheel operates is readily apparent. Type fonts having the desired informational material are mounted on the outer surface 40 of the moveable type carrier 35 which is freely rotatable on bearings 29 and 31 relative to spindle assembly 10. The support member 3 is then fixed to some part of a product processing line as taught in the prior art so that the type will contact the products as they move along the processing line. The friction members seated in grooved flanges 37 and 39 are contacted by the product and cause the type carrier to rotate to bring the type face into contact with the article to be imprinted. As the article moves past the printing wheel, the wheel must return to a predetermined so called null position where the type face is at a predetermined position when the wheel is at rest before it is contacted by each product. This assures that the imprinted information is located at the same place on each article and that each article is properly printed upon as it moves past the printing wheel.

The return to the null position is affected by the magnetic attraction between the annular magnets 27 and 45 since these members tend to align themselves in accordance with the known physical laws with opposite poles attracted to each other. Thus when the wheel is free to move it will always automatically return to the same null position as determined by the orientation of the North-South poles of the magnets 27, 45 regardless of how far or how little the type carrier is rotated by contact with the moving product or article.

Obviously as the type carrier rotates back to the null position under the influence of magnets 27 and 45 it will develop some degree of rotational velocity which will tend to carry it past the null position which will result in a "hunting" i.e. back and forth oscillation of the type carrier until the angular velocity is dissapated. The magnetic pole pieces 21 and 47, one being stationary on spindle assembly 10, the other being moved with type carrier, act as a damping mechanism to diminish this hunting action since, as they are aligned, there is an additional magnetic force acting between the stationary assembly 10 and the moveable type carrier 35 tending to hold the type carrier in the one stationary or null position. Thus all mechanical null positioning devices known in the art, such as cams and springs and cam followers, etc., are completely eliminated and outside of possible bearing wear and occasional renewal of the friction surfaces seated in grooved flanges 37 and 39 there are no parts which will wear out in the disclosed device.

Having described a preferred form of carrying out the inventive concept it will be apparent that changes and modifications will occur to those skilled in the art but all of which fall within the spirit and scope of the concept which is limited only as defined in the appended claims, wherein:

What is claimed is:

1. A printing wheel comprising a stationary spindle assembly, said assembly including a vertical hub having a flat, disc-shaped upper surface; a first magnetic means including a first magnetic pole piece carried on said upper surface; a rotatable type carrier mounted on said hub, said type carrier being in the form of a cylinder and having an open top end; cover means closing the open top end of said type carrier; a second magnetic means carried by said cover means and positioned adjacent said first mentioned magnetic means whereby said cylindrical type carrier is biased to a null position after any rotation of the type carrier relative to said spindle assembly.

2. A printing wheel as defined in claim 1 including additional magnetic pole pieces one each being mounted on said spindle assembly and said type carrier and positioned to cooperate with said first and second mentioned magnetic means to prevent said type carrier from hunting upon its return toward said null position.

3. The printing wheel as defined in claim 1 wherein said first and second mentioned magnetic means are comprised of a pair of identically annular magnetized members.

4. A printing wheel as defined in claim 2 wherein said additional pole pieces are mounted on the spindle assembly and in the rotatable type carrier for alignment in close proximity to each other along a plane disposed parallel to and below a plane passing between said first and second magnetic mentioned magnetic means.

* * * * *